US006405396B1

(12) United States Patent
Tsai

(10) Patent No.: US 6,405,396 B1
(45) Date of Patent: Jun. 18, 2002

(54) SCREWDRIVER ASSEMBLY WITH AN EXTENDABLE ROD

(76) Inventor: Chiung-Chang Tsai, No. 255, Hsi-Hwu Rd., Ta-Li City, Ta-Li City, Taichung Hsien (TW)

( * ) Notice: Subject to any disclaimer, the term of this patent is extended or adjusted under 35 U.S.C. 154(b) by 0 days.

(21) Appl. No.: 09/866,589

(22) Filed: May 30, 2001

(51) Int. Cl.[7] ..... B25B 15/00
(52) U.S. Cl. ..... 7/165; 81/177.4
(58) Field of Search ..... 81/177.4, 490; 7/165, 901

(56) References Cited

U.S. PATENT DOCUMENTS 562,416 A * 6/1896 Powers et al. ..... 7/165
1,250,328 A * 12/1917 Langford ..... 81/177.4
5,868,048 A * 2/1999 Cassutti et al. ..... 81/490
5,878,637 A * 3/1999 Liu ..... 81/451
5,901,622 A * 5/1999 Sweeny ..... 7/165
5,913,596 A * 6/1999 Lin ..... 362/120
5,957,014 A * 9/1999 Tseng et al. ..... 81/490
6,105,190 A * 8/2000 Shiao ..... 7/165
6,260,980 B1 * 7/2001 Ping ..... 7/901

* cited by examiner

*Primary Examiner*—Joseph J. Hail, III
*Assistant Examiner*—Joni B. Danganan
(74) *Attorney, Agent, or Firm*—Jones, Tullar & Cooper, P.C.

(57) ABSTRACT

A screwdriver assembly includes a first handle having a first hollow shank axially inserted into the first handle for connecting a tip and a second handle detachably secured in one end of the first handle opposite to the hollow shank. A second hollow shank is axially inserted into the second handle for connecting an extendable rod. The extendable rod includes one end opposite to the second handle and having a magnet secured to retrieve an object, such as a bolt, from a confined space such as a deep hole.

1 Claim, 6 Drawing Sheets

SCREWDRIVER ASSEMBLY WITH AN EXTENDABLE ROD

BACKGROUND OF THE INVENTION

1. Field of the Invention

The present invention relates to a multifunction screwdriver assembly, and more particularly to a screwdriver assembly with a extendable rod having a magnet attached to an end of the extendable rod to retrieve an element, such as a bolt, from a confined space such as a deep hole.

2. Description of Related Art

With reference to FIG. 6, a conventional screwdriver in accordance with the prior art comprises a handle (50), a shank (60) detachably inserted into the handle (50) and a tip (70) inserted into the shank (60). The handle (50) has an axial bore (51) defined in one end of the handle (50). Two diametrically opposite longitudinal keyways (52) are respectively defined in the bore (51). An axial through hole is defined through the shank (60). Two opposite ends of the through hole are polygonal. Two diametrically opposite ribs (not shown) extend outward from the periphery of the hollow shank (60) near the middle portion to engage the corresponding keyways (52) when the hollow shank (60) is inserted into the handle (50). The tip (70) has at least one working end and a middle portion to insert into and engage the polygonal end of the shank (60).

The working end of the tip (70) can drive a screw well. However, the conventional screwdriver cannot retrieve a bolt from a deep hole or align the bolt with a threaded hole in confined space such as the bottom of a deep hole.

Consequently, a screwdriver assembly with an extendable magnet was developed. With reference to FIG. 7, the conventional screwdriver assembly (80) having an extendable magnet in accordance with the prior art comprises a hollow shank (81) and a handle (82) engaged to one end of the shank (81). A polygonal hole (811) is defined in the other end of the hollow shank (81) for engaging a tip (83) to drive a screw or bolt. An extendable rod (84) is received in the hollow shank (81). One end of the extendable rod (84) is secured in the handle (82), and a magnet (841) is attached to the other end. The extendable rod (84) may extend outward from the shank (81) and into a confined space such as a deep hole to retrieve an element such as a bolt, a nut, etc.

However, the extendable rod (84) is received in the hollow shank (81) so that the hollow shank (81) must be removed before using the extendable rod (84). It is inconvenient for user to use the extendable rod (84) to retrieve an object such as a bolt from a confined space such as a hole.

The present invention has arisen to mitigate and/or obviate the disadvantages of the two conventional screwdrivers.

SUMMARY OF THE INVENTION

The main objective of the present invention is to provide an improved screwdriver assembly. To achieve the objective, the screwdriver assembly in accordance with the present invention comprises a first handle having a first hollow shank axially inserted into the first handle for connecting a tip and a second handle detachably secured in one end of the first handle opposite to the hollow shank. A second hollow shank is axially inserted into the second handle for connecting an extendable rod. The extendable rod includes one end opposite to the second handle and having a magnet secured to retrieve an object, such as a bolt, from a confined space such as a blind hole.

Further benefits and advantages of the present invention will become apparent after a careful reading of the detailed description with appropriate reference to the accompanying drawings.

DETAILED DESCRIPTION OF THE INVENTION

Figure 1:
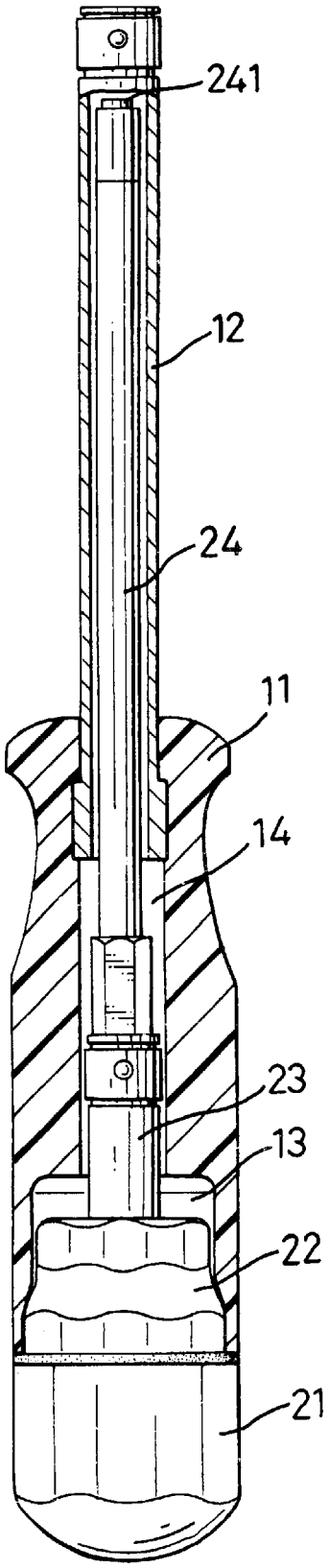
FIG. 1 is a side plan view in partial section of a screwdriver assembly in accordance with the present invention.
Figure 2:
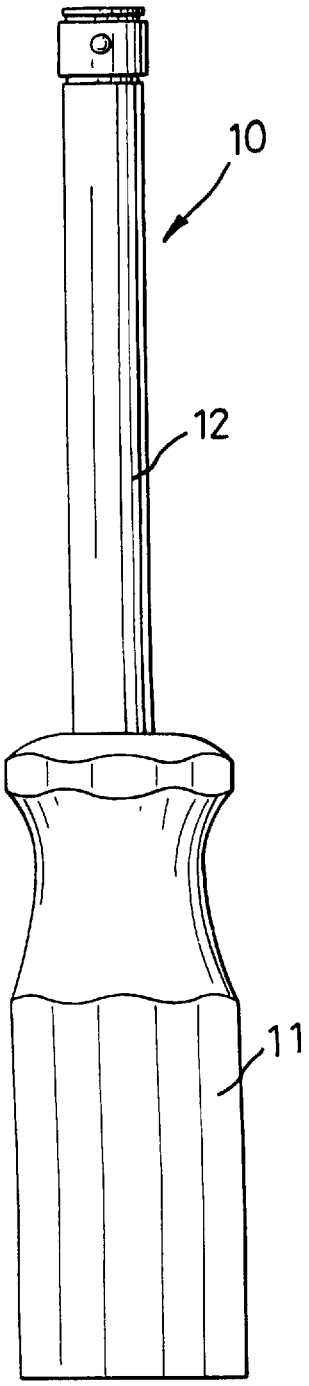
FIG. 2 is a side plan view of the first tool of the screwdriver assembly in FIG. 1.
Figure 3:
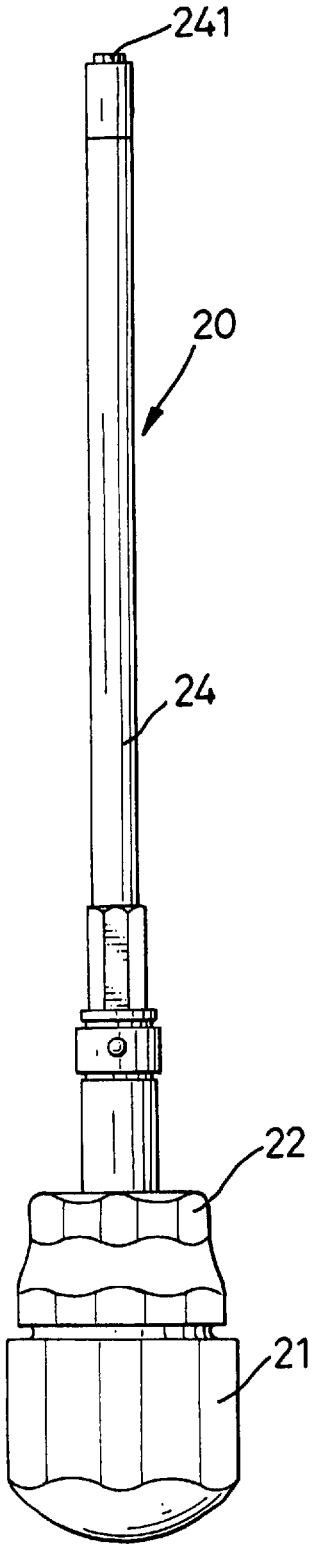
FIG. 3 is a side plan view of a second tool of the screwdriver assembly in FIG. 1.

Referring to the drawings and initially to FIGS. 1 to 3, a screwdriver assembly in accordance with the present invention comprises a first tool (10) and a second tool (20) partially received and detachably secured in the first tool (10).

Figure 4:
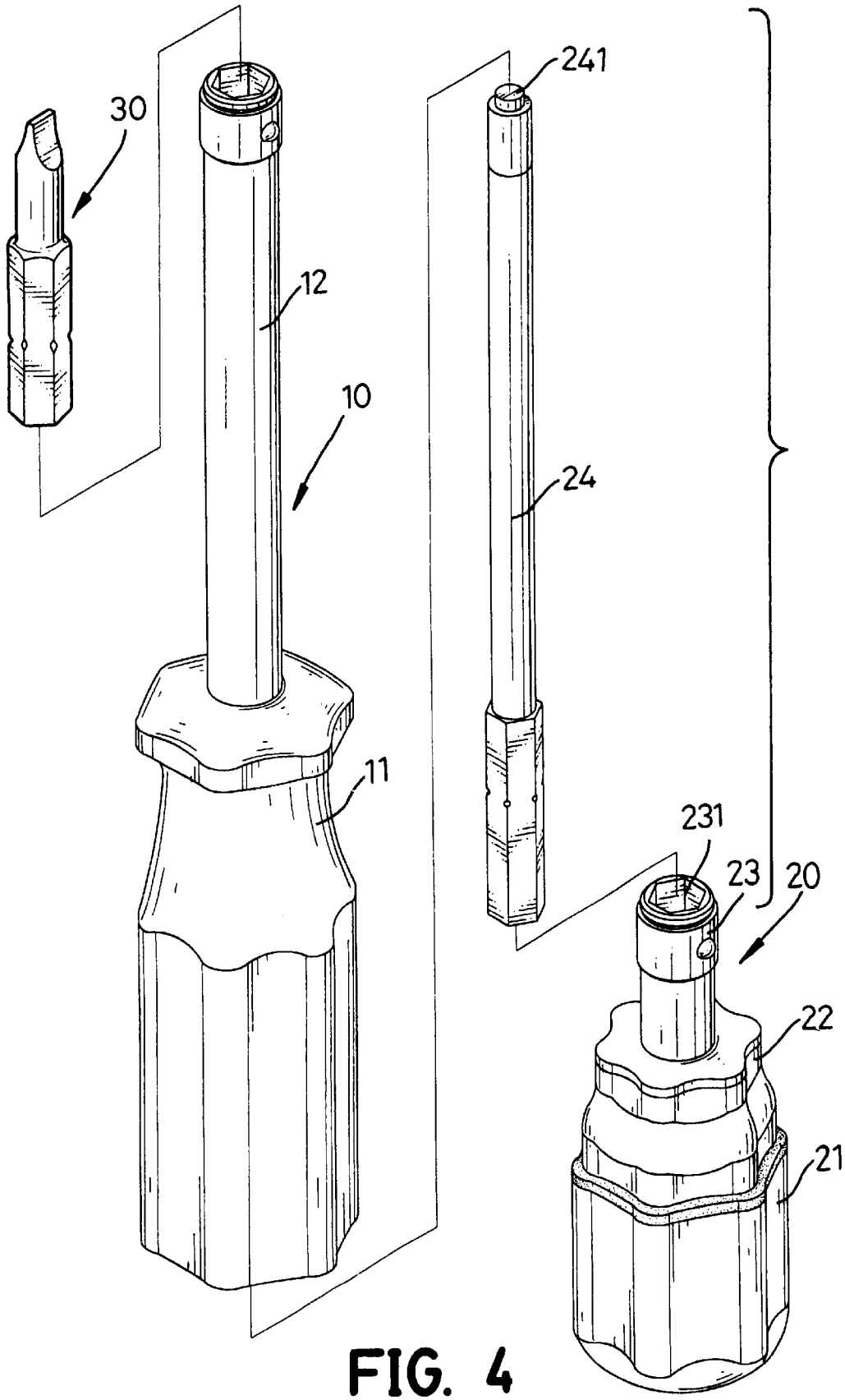
FIG. 4 is an exploded perspective view of the screwdriver assembly in FIG. 1.

With reference to FIGS. 1, 2 and 4, the first tool (10) includes a first handle (11) and a first hollow shank (12). The first handle (11) has a first end, a second end, an axial passage (14) extending from the first end toward the second end and an axial cavity (13) in the second end, which communicates with the passage (14). The first hollow shank (12) has a distal end and a proximal end, and the proximal end is axially inserted into and secured the passage (14) in the first end of the first handle (11) of the first tool (10). The interior of the distal end of the first hollow shank (12) is polygonal and adapted to receive and engage a tip (30). A cavity (13) is axially defined in the second end of the first handle (11). The interior of the proximal end of the first hollow shank (12) communicates with the passage (14) and cavity (13) defined in the first handle (11).

With reference to FIGS. 1, 3 and 4, the second tool (20) includes a second handle (21), a stub (22), a second shank (23) and an extendable rod (24). The second handle (21) has a first end and a second end. The stub (22) axially extends from the first end of the second handle (21) toward the first handle (11) of the first tool (10). The shape of the stub (22) corresponds to and is slightly larger than the cavity (13) in the second end of the first handle (11) so the second handle (21) can be held in the second end of the first handle (11) when the stub (22) is inserted into the cavity (13) of the first handle (11). The second shank (23) has a distal end and a proximal end, and the proximal end is axially inserted into and secured in the stub (22). The second shank (23) has an outside diameter smaller than the inside diameter of the passage (14) in the first handle (11). A polygonal hole (231) is axially defined in distal end of the second shank (23) to partially receive the extendable rod (24). The extendable rod (24) has a distal end and polygonal proximal end. The polygonal proximal end is received and engaged in the polygonal hole (231) in the stub (22), and a magnet (241) secured on the distal end of the extendable rod (24). The second shank (23) is received in the passage (14) in the first handle (11) and the extendable rod (24) is received in the first shank (12) when the second handle (21) is inserted into the first handle (11).

Figure 5:
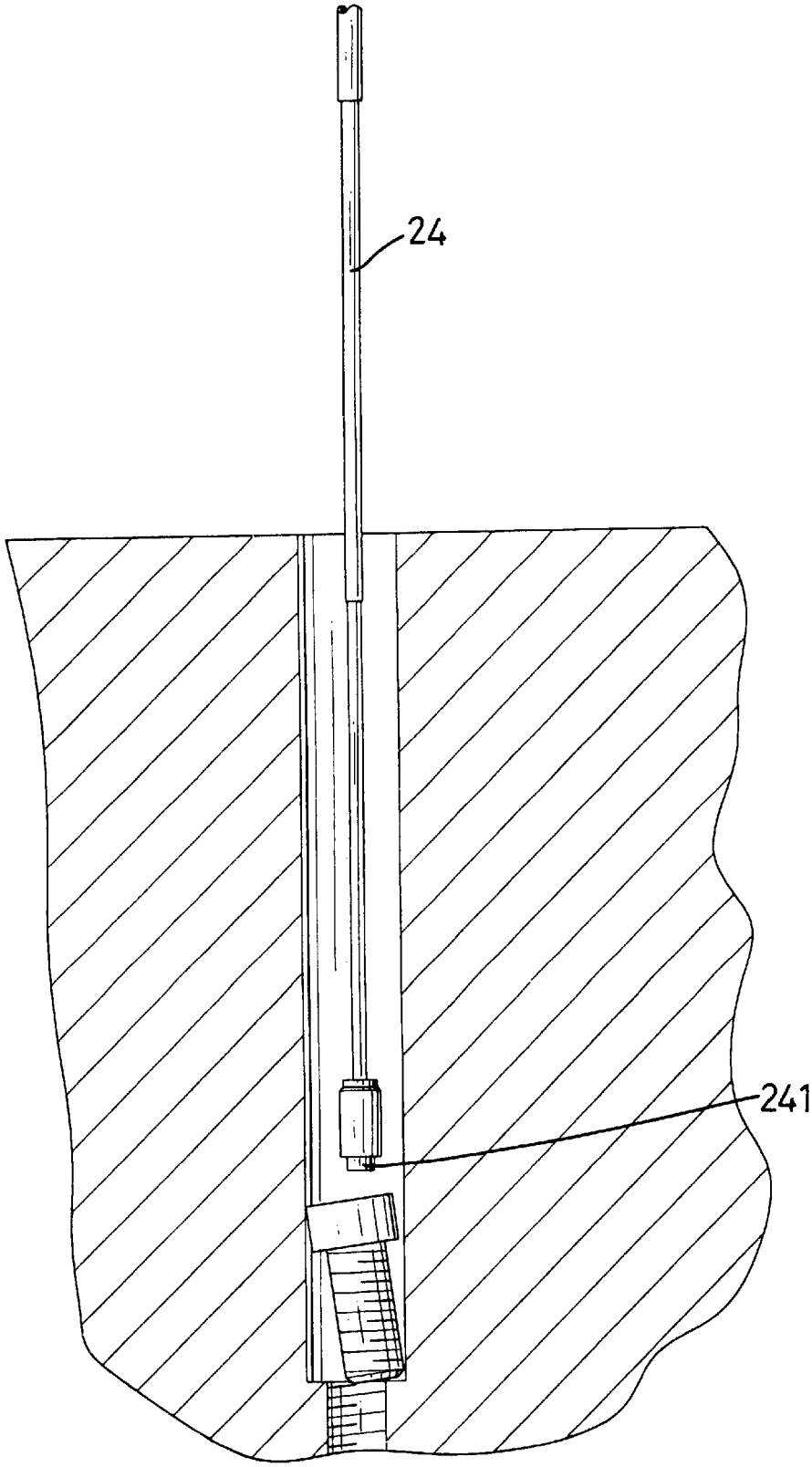
FIG. 5 is an operational side plan view of the second tool of the screwdriver assembly in FIG. 3 in use.
Figure 6:
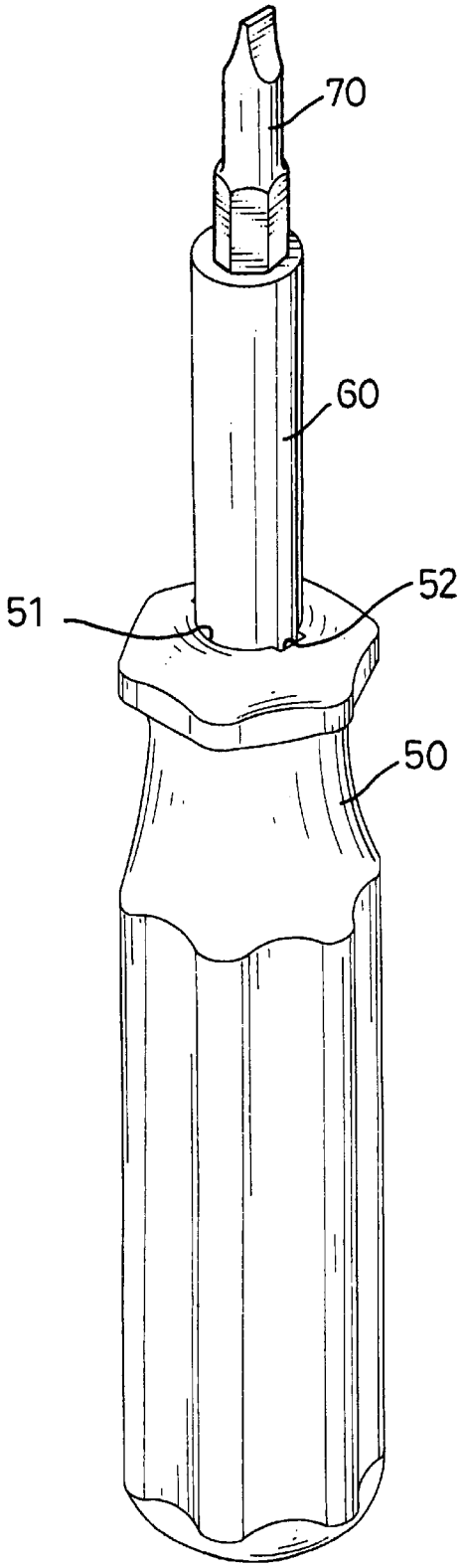
FIG. 6 PRIOR ART
FIG. 6 is perspective view of a conventional screwdriver in accordance with the prior art.
Figure 7:
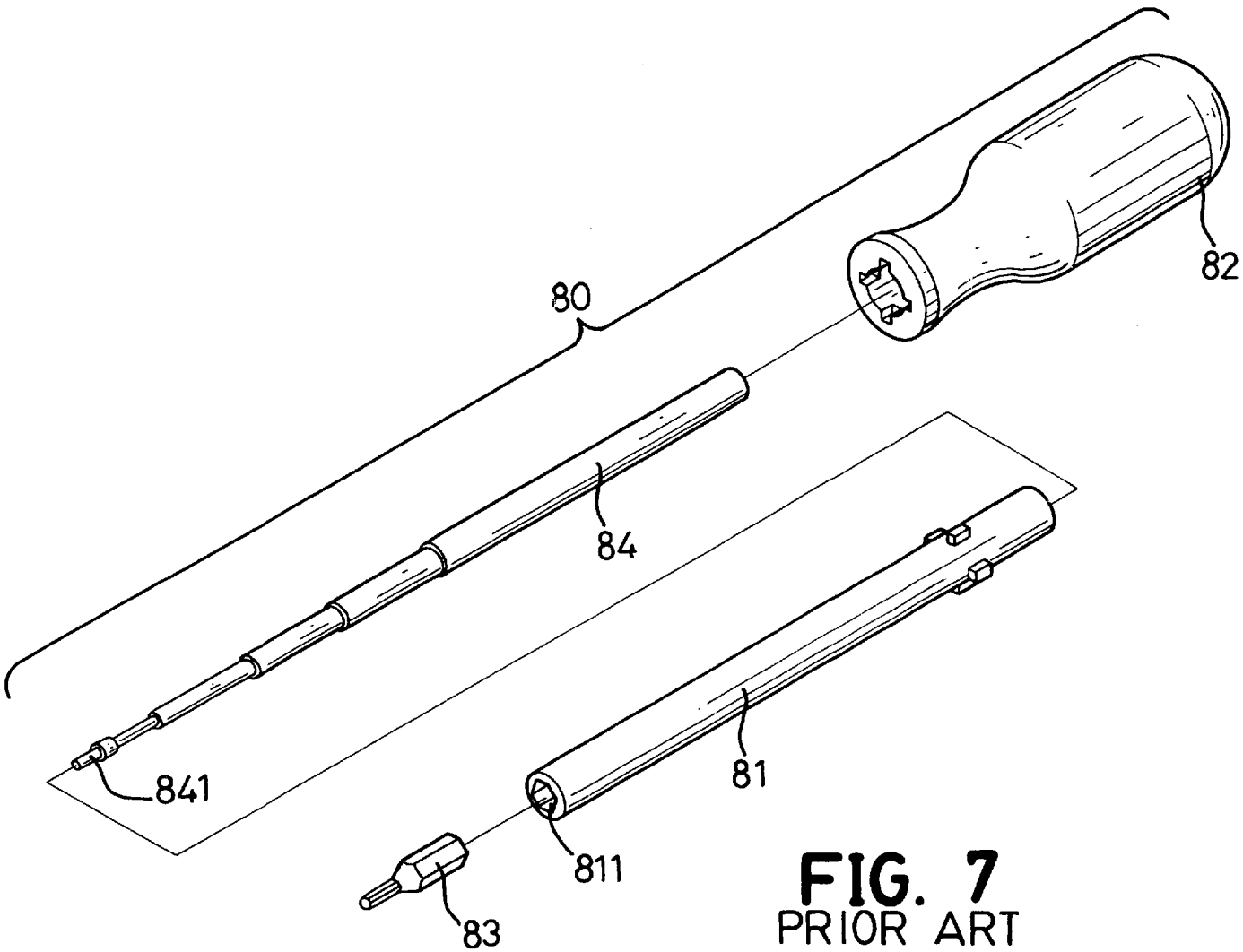
FIG. 7 PRIOR ART
FIG. 7 is an exploded perspective view of another conventional screwdriver assembly in accordance with the prior art.

With reference to FIG. 5, the extendable rod (24) can retrieve an object, such as a bolt, from a confined area such as a deep hole due to the magnet (241) secured on the top of the extendable rod (24). Furthermore, the extendable rod (24) can be replaced with a tip so that the screwdriver assembly may have two screwdrivers with different specifications and can be carried together to accommodate different working conditions. Consequently, it is a convenient design for the user to use the screwdriver.

Although the invention has been explained in relation to its preferred embodiment, it is to be understood that many other possible modifications and variations can be made without departing from the spirit and scope of the invention as hereinafter claimed.

What is claimed is:

1. A screwdriver assembly comprising:

a first tool having a first handle (11) with a first end, a second end, and axial passage (14) extending from the first end toward the second end and an axial cavity (13) in the second end, which communicates with the passage (14); and a first hollow shank (12) with a distal end and a proximal end where the proximal end is axially inserted into and secured in the first end of the first handle (11), an interior of the distal end being polygonal and adapted to receive and engage a tip (30); and a second tool (20) partially and detachably in the cavity (13) in the first handle (11) including:

a second handle (21);

a stub (22) axially extending from the second handle (21) toward the first handle (11), the stub (22) having a shape corresponding to and slightly large than that of the cavity (13);

a second shank (23) axially inserted into and secured in the stub (22), the second shank (23) having an outside diameter smaller than an inside diameter of the passage (14) so that the second shank (23) can be received in the passage (14) when the second tool (20) is connected to the first tool (10), a polygonal hole (231) axially defined in the second shank (23);and an extendable rod (24) including a distal end and a polygonal proximal end where the polygonal proximal end is fixed received in the polygonal hole (231) in the second hollow shank (23) and a magnet (241) secured on the distal end of the extendable rod (24).

* * * * *